US011386829B2

(12) United States Patent
Xiong et al.

(10) Patent No.: US 11,386,829 B2
(45) Date of Patent: Jul. 12, 2022

(54) DISPLAY PANEL AND DRIVE METHOD THEREOF, AND DISPLAY DEVICE

(71) Applicants: Wuhan Tianma Micro-Electronics Co., Ltd., Wuhan (CN); Wuhan Tianma Microelectronics Co., Ltd. Shanghai Branch, Shanghai (CN)

(72) Inventors: Nana Xiong, Shanghai (CN); Jujian Fu, Shanghai (CN)

(73) Assignees: Wuhan Tianma Micro-Electronics Co., Ltd., Wuhan (CN); Wuhan Tianma Microelectronics Co., Ltd. Shanghai Branch, Shanghai (CN)

( * ) Notice: Subject to any disclaimer, the term of this patent is extended or adjusted under 35 U.S.C. 154(b) by 0 days.

(21) Appl. No.: 17/004,869

(22) Filed: Aug. 27, 2020

(65) Prior Publication Data

US 2021/0407363 A1 Dec. 30, 2021

(30) Foreign Application Priority Data

Jun. 30, 2020 (CN) ..... 202010622614.9

(51) Int. Cl.
*G09G 3/20* (2006.01)
*G09G 3/3208* (2016.01)

(52) U.S. Cl.
CPC ..... *G09G 3/2003* (2013.01); *G09G 3/2025* (2013.01); *G09G 3/3208* (2013.01); *G09G 2300/0452* (2013.01)

(58) Field of Classification Search
CPC .. G09G 3/2003; G09G 3/2025; G09G 3/3208; G09G 2300/0452
See application file for complete search history.

(56) References Cited

U.S. PATENT DOCUMENTS

2008/0079677 A1* 4/2008 Tai ..... G09G 3/3413 345/88
2008/0224973 A1* 9/2008 Louwsma ..... G09G 3/342 345/88
2011/0157243 A1* 6/2011 Chen ..... G09G 3/3659 345/690

(Continued)

FOREIGN PATENT DOCUMENTS

CN 1381029 A 11/2002
CN 101426079 A 5/2009

(Continued)

*Primary Examiner* — Premal R Patel
(74) *Attorney, Agent, or Firm* — Anova Law Group, PLLC

(57) ABSTRACT

A display panel and its drive method, and a display device are provided in the present disclosure. The method for driving the display panel includes refreshing a first-color picture N times in one frame. A time interval between every two adjacent refreshings of the N times of the refreshing is T1 for the first-color picture, T1=T2/N, T2 is a duration of the one frame, N>1, and N is a positive integer. The first-color picture may be refreshed multiple times in the one frame, and the multiple refreshing processes of the first-color picture may be evenly distributed, which may reduce each picture retention duration after the first-color picture is refreshed. Furthermore, before the human eyes are not able to recognize the brightness decrease of a previous first-color picture, a next first-color picture is refreshed, thereby effectively improving the picture flickering phenomenon of the display panel.

17 Claims, 14 Drawing Sheets

(56) References Cited

U.S. PATENT DOCUMENTS

| | | | | |
|---|---|---|---|---|
| 2014/0218417 | A1* | 8/2014 | Kawabe | G09G 3/3225 345/690 |
| 2016/0055788 | A1* | 2/2016 | Gandhi | G09G 3/2029 345/693 |
| 2016/0092010 | A1* | 3/2016 | Agarwal | G09G 5/12 345/173 |
| 2016/0370915 | A1* | 12/2016 | Agarwal | G06F 3/04184 |
| 2018/0102092 | A1* | 4/2018 | Kubota | G09G 3/3233 |

FOREIGN PATENT DOCUMENTS

| | | | |
|---|---|---|---|
| CN | 106652878 | A | 5/2017 |
| CN | 111179847 | A | 5/2020 |

* cited by examiner

DISPLAY PANEL AND DRIVE METHOD THEREOF, AND DISPLAY DEVICE

CROSS-REFERENCE TO RELATED APPLICATION

This application claims the priority of Chinese Patent Application No. 202010622614.9, filed on Jun. 30, 2020, the content of which is incorporated herein by reference in its entirety.

TECHNICAL FIELD

The present disclosure generally relates to the field of display technology and, more particularly, relates to a display panel and its drive method, and a display device.

BACKGROUND

Currently, organic light-emitting diode (OLED) displays are considered as next-generation flat-panel displays with emerging application technology, because of their characteristics, including self-illumination, non-backlight, high contrast, thin thickness, wide viewing angle, fast response time, applicability as flexible panels, wide range of use temperature, simple structure and manufacturing process, and the like.

OLED displays often use a low-frequency drive mode to reduce the display power consumption. However, flickering is likely to occur when pictures are displayed at the low-frequency drive mode, which may affect the display effect of the displays. Therefore, there is a need to provide a display panel and a drive method thereof, and a display device to solve technical problems such as visible flickering of the displayed picture.

SUMMARY

One aspect of the present disclosure provides a method for driving a display panel. The method includes refreshing a first-color picture N times in one frame, where a time interval between every two adjacent refreshings of the N times of the refreshing is T1 for the first-color picture, T1=T2/N, T2 is a duration of the one frame, N>1, and N is a positive integer.

Another aspect of the present disclosure provides a display panel, including a picture refreshing module and a plurality of first-color sub-pixels. The picture refreshing module is configured to refresh a first-color picture N times in one frame, where a time interval between every two adjacent refreshings of the N times of the refreshing is T1 for the first-color picture, T1=T2/N, T2 is a duration of the one frame, N>1, and N is a positive integer; and at least a portion of the plurality of first-color sub-pixels is configured to display the first-color picture.

Another aspect of the present disclosure provides a display device, including the above-mentioned display panel. The display panel includes a picture refreshing module and a plurality of first-color sub-pixels. The picture refreshing module is configured to refresh a first-color picture N times in one frame, where a time interval between every two adjacent refreshings of the N times of the refreshing is T1 for the first-color picture, T1=T2/N, T2 is a duration of the one frame, N>1, and N is a positive integer; and at least a portion of the plurality of first-color sub-pixels is configured to display the first-color picture.

Other aspects of the present disclosure can be understood by those skilled in the art in light of the description, the claims, and the drawings of the present disclosure.

BRIEF DESCRIPTION OF THE DRAWINGS

By reading the detailed description of the non-limiting embodiments made with reference to the following drawings, other features, objectives, and advantages of the present disclosure become more apparent.

DETAILED DESCRIPTION

Figure 1:
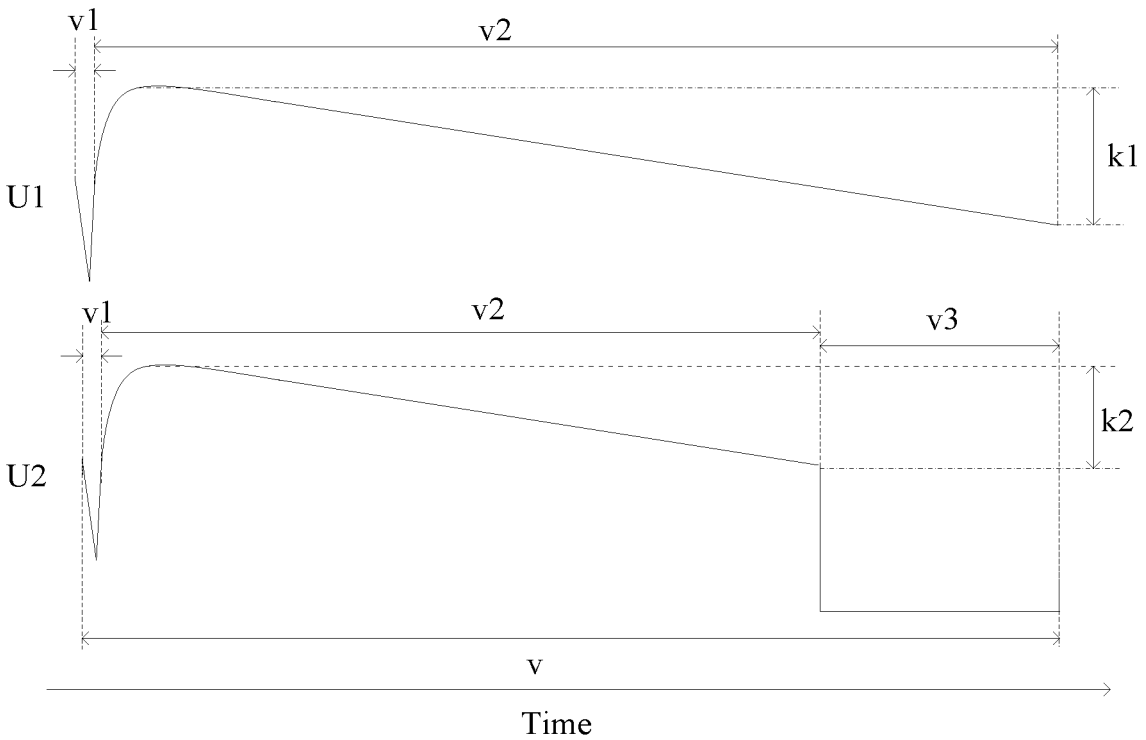
FIG. 1 illustrates a schematic of a change curve of display panel brightness with time in one frame in an existing technology.

To further describe the technical means and effects of the present disclosure to achieve the intended purpose of the disclosure, the implementation manners, structures, features and effects of a display panel and its drive method, and a display device according to the present disclosure are described in detail in conjunction with the accompanying drawings and preferred embodiments hereinafter.

The embodiments of the present disclosure provide the drive method of the display panel, including refreshing a first-color picture N times in one frame. A time interval between every two adjacent refreshings of the N times of the refreshing is T1 for the first-color picture, where T1=T2/N, T2 is a duration of the one frame, N>1, and N is a positive integer.

In the technical solutions provided by the embodiments of the present disclosure, the first-color picture may be refreshed N times in one frame. The time interval between every two adjacent refreshings of the N times of the refreshing is T1 for the first-color picture, where T1=T2/N, T2 is a duration of the one frame, N>1, and N is a positive integer. In such way, the first-color picture may be refreshed multiple times in one frame, and the multiple refreshing processes of the first-color picture may be evenly distributed in one frame, which may reduce the picture retention duration after each first-color picture is refreshed. Furthermore, before human eyes are not able to recognize the brightness decrease of a previous first-color picture, a next first-color picture is refreshed, which may effectively improve the picture flickering phenomenon.

The technical solutions in the embodiments of the present disclosure are described clearly and completely in conjunction with the drawings in the embodiments of the present disclosure. Obviously, the described embodiments are merely a part of the embodiments of the present disclosure, but not all the embodiments. Based on the embodiments of the present disclosure, all other embodiments obtained by those skilled in the art without creative work fall within the protection scope of the present disclosure.

In the following description, various details are set forth in order to fully understand the present disclosure. However, the present disclosure may also be implemented in other embodiment manners different from those described herein, and those skilled in the art may make similar promotion without violating the connotation of the present disclosure. Therefore, the present disclosure may not be limited by the embodiments disclosed below.

Moreover, the present disclosure is described in detail in conjunction with the schematics. When describing the embodiments of the present disclosure in detail, the schematics showing the device structures may not be partially enlarged according to the general scale for the convenience of description, and the schematics may only be examples which may not limit the protection scope of the present disclosure. In addition, three-dimensional sizes including length, width and height should be included in the actual device manufacturing.

In a low frequency drive mode of the OLED display, the duration of a brightness retention stage v2 in one frame v may increase. Due to the characteristics of the driving circuit, the brightness may gradually change during the brightness retention stage v2. For example, the brightness may gradually decrease, referring to a curve U1 in FIG. 1 for details, which causes the picture flickering problem. In the existing technology, the picture flickering problem may be solved by adding a blanking stage v3 in one frame v or between adjacent frames. During the blanking stage v3, the brightness is zero, that is, a black picture is added, referring to a curve U2 in FIG. 1. Therefore, the duration of the normal brightness retention stage v2 of a picture may be reduced, the reduction amount of picture brightness in the brightness retention stage v2 may be reduced (k2<k1), thereby improving the picture flickering phenomenon. Since the picture refreshing process is completed in an initial period (a picture refreshing stage v1) of one frame v, the picture flickering problem may still exist even if the blanking stage v3 is increased.

In order to solve the picture flickering problem, the embodiments of the present disclosure provide a drive method of a display panel, including refreshing the first-color picture N times in one frame. The time interval between every two adjacent refreshings of the N times of the refreshing is T1 for the first-color picture, where T1=T2/N, T2 is a duration of one frame, N>1, and N is a positive integer.

Figure 2:
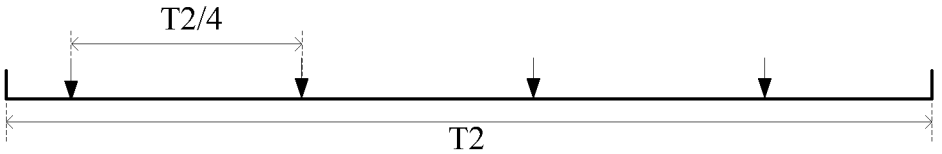
FIG. 2 illustrates a schematic of the distribution of refreshing time points of a first-color picture in one frame according to various embodiments of the present disclosure.

Exemplarily, FIG. 2 illustrates a schematic of the distribution of refreshing time points of the first-color picture in one frame according to various embodiments of the present disclosure. FIG. 2 illustrates the refreshing time point of the first-color picture with a one-way arrow (e.g., the refreshing starting time of the first-color picture). As shown in FIG. 2, taking refreshing the first-color picture 4 times as an example, the time interval between two adjacent refreshings may be T2/4 in one frame with the duration of T2.

It should be noted that the time interval between two adjacent refreshings may be the sum of the refreshing duration and the brightness retention duration of one first-color picture. The refreshing duration of any first-color picture may be significantly shorter than the retention duration. Exemplarily, the ratio of the refreshing duration to the retention duration of the first-color picture may be 1:59. Therefore, the setting manner of the brightness retention stage may have a greater impact on the flickering phenomenon of the picture.

It also should be noted that the display panel may include a plurality of first-color sub-pixels; each first-color picture may be displayed by a portion or all of the first-color sub-pixels; any two of first-color pictures may be displayed by a same plurality of first-color sub-pixels, or by a different plurality of first-color sub-pixels, which may not be limited according to the embodiments of the present disclosure.

In various embodiments of the present disclosure, one frame may correspond to a same picture. For example, if the picture is a color picture, the picture may correspond to a set of data information, and the set of data information may include green sub-pixel data information, red sub-pixel data information, and blue sub-pixel data information. When displaying the picture, the data in the set of data information may be selectively chosen for the display. For example, if the first-color picture is a green picture, when refreshing the first-color picture, all of the green sub-pixel data information or a portion of the green sub-pixel data information in the set of data information may be selected to display the first-color picture according to a preset refreshing manner.

In the technical solutions provided by one embodiment, by refreshing the first-color picture N times in one frame, the time interval between two adjacent refreshings may be T1 for the first-color picture, where T1=T2/N, T2 is the duration of one frame, N>1, and N is a positive integer. In such way, the first-color picture may be refreshed multiple times in one frame, and the multiple refreshing processes of the first-color picture may be evenly distributed in one frame. That is, the refreshing processes of the first-color picture may be set at intervals and evenly distributed in the time dimension in one frame. Compared with the solution of only increasing the refreshing frequency during the initial period of the frame, the present solution may supplement the display of the blank stage (blanking stage) in one frame on the basis of reducing the brightness retention period and the brightness reduction magnitude after refreshing the first-color picture. Before human eyes are not able to recognize the brightness reduction of a previous first-color picture, a next first-color picture is able to be refreshed, which may effectively improve the picture flickering phenomenon and the saturation of the picture display.

Optionally, the display panel may include the plurality of first-color sub-pixels, and at least a portion of the first-color sub-pixels may be configured to display the first-color picture. The time interval between two adjacent refreshings is T1, which may include the time interval between scans of the first first-color sub-pixel is T1 in two adjacent refreshings of the first-color picture.

"The first first-color sub pixel" may refer to the first-color sub-pixel which is scanned for the first time during the current picture refreshing process among the plurality of first-color sub-pixels used to display a same first-color picture.

Exemplarily, the display panel may include first-color sub-pixels arranged in V rows and Y columns. The first-color picture refreshed for the first time and the first-color picture refreshed for the second time may both be displayed by the above-mentioned first-color sub-pixels in V rows and Y columns, and both refreshings may scan each first-color sub-pixel row by row starting from the first row and the first column. At this point, at two refreshings of the first-color picture, the refreshing time interval of the first-color sub-pixel in the first row and the first column may be T1, and the time when the first first-color sub-pixel is scanned may correspond to the refreshing time point in FIG. 2. The values of X and Y may be set according to actual application requirements.

Figure 3:
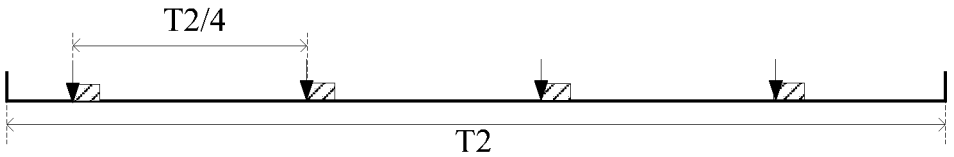
FIG. 3 illustrates another schematic of the distribution of refreshing time points of a first-color picture in one frame according to various embodiments of the present disclosure.

For example, FIG. 3 illustrates another schematic of the distribution of refreshing time points of the first-color picture in one frame according to various embodiments of the present disclosure. In FIG. 3, a rectangular box filled with shadow is used to illustrate the refreshing time of the first-color picture, and a one-way arrow is used to illustrate the refreshing starting time of the first-color picture, that is, the time when the first first-color sub-pixel is scanned. As shown in FIG. 3, in one frame with the duration of T2, the first-color picture is refreshed 4 times; and in two adjacent refreshings of the first-color picture, the time interval between scans of the first first-color sub-pixels may be T2/4.

It should be noted that the first sub-pixel of the first-color picture may be fixed, easy to identify, and may not be related to the difference at each refreshing process. The time that the first first-color sub-pixel is refreshed may be used to mark the current picture refreshing time point, which may be advantageous for reducing the difficulty of determining the first-color picture refreshing timing.

Optionally, the time interval between two adjacent refreshing processes may be determined by the input time of scan starting signals (e.g., STV signals) in two adjacent refreshing processes of the first-color picture.

It should be noted that the working stages of a sub-pixel may include an initialization stage, a data write stage, and a light-emitting stage. The refreshing stage in various embodiments of the present disclosure may be understood as the time period shared by the initialization stage and the data write stage of each refreshed sub-pixel when a certain picture is refreshed. The brightness retention stage in various embodiments of the present disclosure may be understood as the overlapping time period of the light-emitting stage of each sub-pixel.

Optionally, the first color may be determined according to the main picture color of a picture source. For example, when the main picture color of the picture source is identified as green by an IC, the first-color picture may be set as the green picture when displaying the picture. That is, the green picture may be refreshed N times in one frame, where for the green picture, the time interval between two adjacent refreshings may be T1, T1=T2/N, T2 is the duration of one frame, N>1, and N is a positive integer. In such way, the refreshing quantity of the green picture may increase, which is beneficial for improving the flickering phenomenon of the picture. Similarly, when the main picture color of the picture source is identified as red by the IC, the first-color picture may be set as the red picture to increase the refreshing quantity of the red picture; and when the main picture color of the picture source is identified as blue by the IC, the first-color picture may be set as the blue picture to increase the refreshing quantity of the blue picture.

Optionally, the first refreshing of the first-color picture may be performed at the frame scan starting point in one frame.

The frame scan starting point may refer to the starting time of the current frame. For example, the duration of the current frame is t1 to t2, and the time t1 may be the frame scan starting point of the frame.

Furthermore, "the first refreshing" may refer to the first refreshing of N times of refreshings of the first-color picture performed in one frame. For example, the first-color picture is refreshed three times in one frame, which includes a b1 refreshing, a b2 refreshing, and a b3 refreshing, where the b1 refreshing is the first refreshing of the first-color picture in the current frame.

Figure 4:
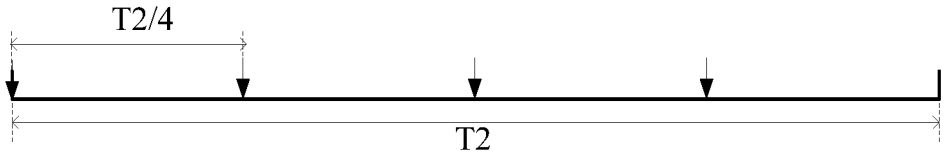
FIG. 4 illustrates another schematic of the distribution of refreshing time points of a first-color picture in one frame according to various embodiments of the present disclosure.

Exemplarily, FIG. 4 illustrates another schematic of the distribution of refreshing time points of the first-color picture in one frame according to various embodiments of the present disclosure. The one-way arrow in FIG. 4 is used to illustrate the refreshing time point of the first-color picture. As shown in FIG. 4, the time point of the first refreshing may coincide with the starting time of one frame, that is, the first refreshing of the first-color picture may be performed at the frame scan starting point in one frame.

It should be noted that, for the manner of performing the first refreshing of the first-color picture at the frame scan starting point in one frame, there is not necessary to separately set the time point of the first refreshing in one frame, and the frame scan starting point may be multiplexed as the time point of the first refreshing, which may be beneficial for reducing the difficulty of the time sequence design. Furthermore, the manner of performing the first refreshing of the first-color picture at the frame scan starting point in one frame may also ensure that the refreshing time interval of two first-color pictures adjacently set in adjacent frames is also T1, which may avoid the picture flickering phenomenon during the two frame changing process.

Figure 5:
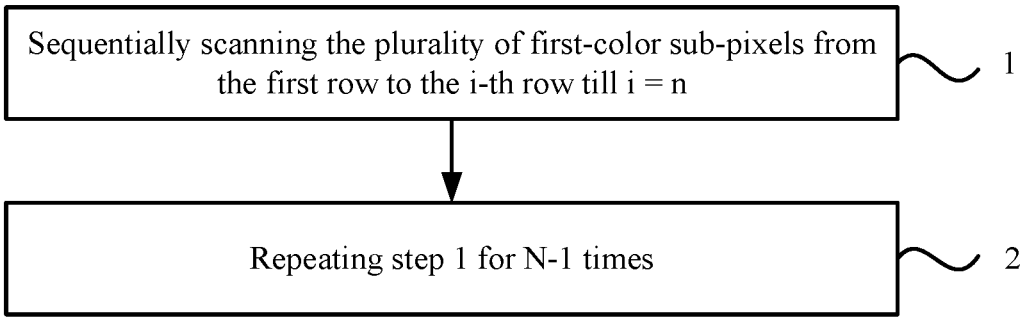
FIG. 5 illustrates a flow chart of refreshing a first-color picture N times according to various embodiments of the present disclosure.

Optionally, the display panel may include the plurality of first-color sub-pixels arranged in n rows, and the plurality of first-color sub-pixels may be configured to display the first-color picture. Correspondingly, FIG. 5 illustrates a flow chart of refreshing the first-color picture N times according to various embodiments of the present disclosure. As shown in FIG. 5, refreshing the first-color picture N times may include the following steps.

At step 1, the first-color sub-pixels starting from a first row to an i-th row are sequentially scanned till i=n, where $1 \leq i \leq n$, and i is a positive integer.

Figure 6:
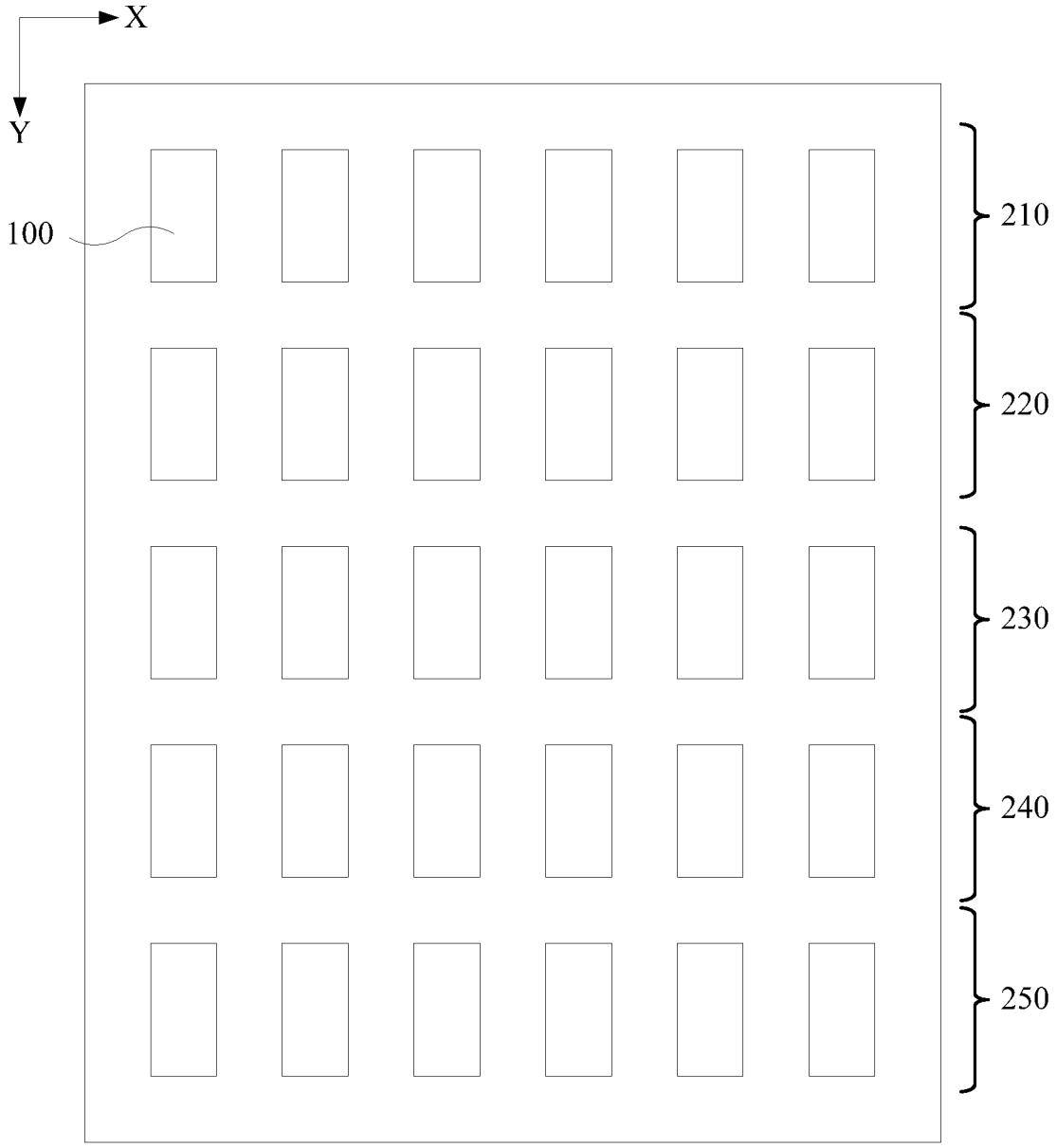
FIG. 6 illustrates a structural schematic of a display panel according to various embodiments of the present disclosure.

For example, FIG. 6 illustrates a structural schematic of a display panel according to various embodiments of the present disclosure. FIG. 6 illustrate the first-color sub-pixels in the display panel. As shown in FIG. 6, exemplarily, the display panel may include five rows of the first-color sub-pixels 100. Along a direction Y perpendicular to a row direction X, the first-color sub-pixels 210 in the first row, the first-color sub-pixels 220 in the second row, the first-color sub-pixels 230 in the third row, the first-color sub-pixels 240 in the fourth row, the first-color sub-pixels 250 in the fifth row may be sequentially scanned.

It should be noted that the display panel including five rows of the first-color sub-pixels is taken as an example in FIG. 6. In practical applications, the row quantity of the first-color sub-pixels included in the display panel may be set according to actual requirements. In addition, the row quantities of sub-pixels in FIG. 12, FIG. 15, and FIG. 19 may be exemplary. In practical applications, the row quantity of the sub-pixels included in the display panel may be set according to actual requirements.

It should be understood that each first-color picture in one embodiment may be displayed by all first-color sub-pixels in the display panel. After all of first-color sub-pixels are scanned, one first-color picture refreshing is completed, such that one first-color picture refreshing is actually completed at step 1.

At step 2, the above-mentioned step 1 is repeated for N−1 times.

That is, the first-color picture may be refreshed N−1 times according to the manner of step 1, and the first-color picture may be refreshed N times in total.

It should be noted that, in one embodiment, the first-color picture which is refreshed each time may be displayed using a same plurality of first-color sub-pixels, which may have a small picture difference; and the first-color picture displayed using all of the first-color sub-pixels in the display panel may be more delicate with desirable display effect.

Optionally, the first-color picture may include pictures from a first first-color picture to an M-th first-color picture. The display panel may include the plurality of first-color sub-pixels arranged in n rows. The first-color sub-pixels in an (M*j+k)-th row may display a k-th first-color picture, where $1<M \leq N$, $1 \leq k \leq M$, $0 \leq j \leq n/M-1$, and M, k, and j are all integers. Correspondingly, refreshing the first-color picture N times may include sequentially performing operations from a first refreshing operation to an M-th refreshing operation, where a k-th refreshing operation may include sequentially scanning the first-color sub-pixels from a k-th row to the (M*j+k)-th row till j=[n/M−1].

In order to illustrate the refreshing manner of the first-color picture in above-mentioned one frame more clearly, FIG. 6 is used as an example for detailed description. As shown in FIG. 6, the display panel may include 5 rows of the first-color sub-pixels 100. The first-color sub-pixels in row 3j+1 may be the first-color sub-pixels when the first first-color picture is refreshed; the first-color sub-pixels in row 3j+2 may be the first-color sub-pixels when a second first-color picture is refreshed; and the first-color sub-pixels in row 3j+3 may be the first-color sub-pixels when a third first-color picture is refreshed. That is, the first-color sub-pixels 210 in the first row and the first-color sub-pixels 210 in the fourth row may be the first-color sub-pixels when the first first-color picture is refreshed; the first-color sub-pixels 210 in the second row and the first-color sub-pixels 210 in the fifth row may be the first-color sub-pixels when the second first-color picture is refreshed; and the first-color sub-pixels 210 in the third row may be the first-color sub-pixels when the third first-color picture is refreshed. Correspondingly, refreshing the first-color picture N times may include sequentially performing the first refreshing operation to the third refreshing operation. Exemplarily, when N=5, refreshing the first-color picture N times may include sequentially performing the first refreshing operation, the second refreshing operation, the third refreshing operation, the first refreshing operation, and the second refreshing operation, that is, the first-color picture may be refreshed five times in total. The first refreshing operation may include sequentially scanning the first-color sub-pixels 210 in the first row and the first-color sub-pixels 240 in the fourth row, starting from the first-color sub-pixels 210 in the first row. The second refreshing operation may include sequentially scanning the first-color sub-pixels 220 in the second row and the first-color sub-pixels in the fifth row 250, starting from the first-color sub-pixels 220 in the second row. The third refreshing operation may include scanning the first-color sub-pixels 230 in the third row.

It should be understood that the quantities of performing refreshing operations from the first refreshing operation to the M-th refreshing operation may not be same due to the influence of the values of N, M, and n; and the row quantities of the first-color sub-pixels included in the first first-color picture to the M-th first-color picture may also not be same, which may not be limited according to the embodiments of the present disclosure.

It should be noted that the refreshed first-color sub-pixels in the first first-color picture to the M-th first-color picture are not completely same or completely different; however, when the refreshed first-color sub-pixels and the un-refreshed first-color sub-pixels jointly display a picture, on the basis of reducing the quantity of scans, the refreshed first-color sub-pixels may compensate for the brightness defect of the un-refreshed first-color sub-pixels compared with the picture that has not be refreshed for a long duration, which may improve the texture of the picture display. Similarly, the above-mentioned scanning method of the refreshing process may enable the first-color sub-pixels involved in each refreshing process to be evenly distributed in the display panel, and the first-color sub-pixels in adjacent rows may be arranged at the intervals of M−1 rows of the first-color sub-pixels. Therefore, the display effects of the first first-color picture to the M-th first-color picture may be similar. It should be noted that when a portion of the first-color sub-pixels is refreshed, other first-color sub-subpixels which have not been refreshed may still in the original brightness retention stage.

Furthermore, the size of the first-color sub-pixels is small, and human eyes may not be able to recognize the first-color sub-pixels in a single row. Therefore, when a portion of the first-color sub-pixels is refreshed, the refreshed portion of the first-color sub-pixels and the un-refreshed first-color sub-pixels may jointly display the picture and bring the display effect that the entire picture has been refreshed, which may reduce the power consumption of the display panel while improving the picture display effect.

It should be noted that scanning the first-color pictures from the first first-color picture to the M-th first-color picture in sequence may ensure that the first-color sub-pixels used in each first-color picture are scanned with similar quantities and avoid the problem that the life span of the display panel is reduced due to obviously excessive scanning quantities of a portion of the first-color sub-pixels.

Moreover, on the basis of the above-mentioned embodiments, N may be an integer multiple of M, and refreshing the first-color picture N times may include sequentially repeating the operations from the first refreshing operation to the M-th refreshing operation for c times, where c=N/M.

Figure 7:
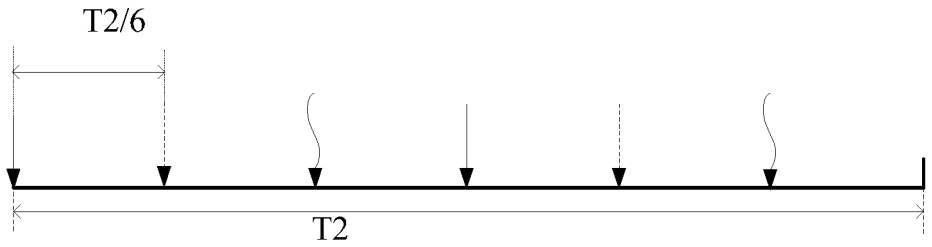
FIG. 7 illustrates another schematic of the distribution of refreshing time points of a first-color picture in one frame according to various embodiments of the present disclosure.

Exemplarily, refreshing the first-color picture 6 times which includes sequentially performing the operations from the first refreshing operation to the third refreshing operation 2 times is used as an example for description. FIG. 7 illustrates another schematic of the distribution of refreshing time points of the first-color picture in one frame according to various embodiments of the present disclosure. In FIG. 7, the one-way arrow is used to illustrate the refreshing time point of the first-color picture. For example, a solid one-way arrow is used to illustrate the refreshing time point of the first refreshing operation, a dotted one-way arrow is used to illustrate the refreshing time point of the second refreshing operation, and a curved one-way arrow is used to illustrate the refreshing time point of the third refreshing operation. As shown in FIG. 7, the operations from the first refreshing operation to the third refreshing operation may be sequentially repeated for 2 times.

It should be noted that when N is an integer multiple of M, the first first-color picture to the M-th first-color picture may be refreshed with a same quantity, such that the first-color sub-pixels corresponding to all of the first-color pictures may be scanned with a same quantity, which further improves the effect of avoiding the life span reduction of the display panel. Furthermore, all of the first-color sub-pixels constituting the entire display picture may be refreshed with a same quantity, which improves the overall display effect of the picture.

The embodiments of the present disclosure also provide a drive method of a display panel. The drive method may include refreshing the first-color picture N times in one frame. For the first-color picture, on the basis of that the time interval between every two adjacent refreshings is T1, the second-color pictures may be refreshed E times, and the third-color pictures may be refreshed F times, where $1 \leq E \leq N$, $1 \leq F \leq N$, and E and F are both positive integers.

Figure 8:
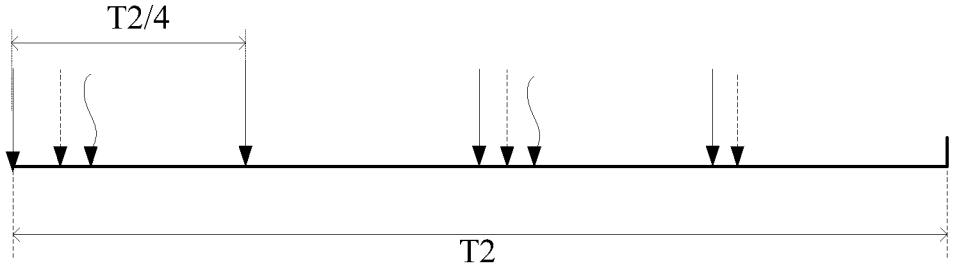
FIG. 8 illustrates a schematic of the distribution of picture refreshing time points in one frame according to various embodiments of the present disclosure.

Exemplarily, FIG. 8 illustrates a schematic of the distribution of picture refreshing time points in one frame according to various embodiments of the present disclosure. In FIG. 8, the one-way arrow is used to illustrate the picture refreshing time point. For example, a straight one-way arrow is used to illustrate the refreshing time point of the first-color picture, a dotted one-way arrow is used to illustrate the refreshing time point of the second-color picture, and a curved one-way arrow is used to illustrate the refreshing time point of the third second-color picture. As shown in FIG. 8, the first-color picture may be refreshed 4 times in one frame with a continuing duration of T2; and for the first-color picture, the time interval between every two adjacent refreshings is T2/4. Furthermore, the second-color picture may be refreshed 3 times, and the third-color picture may be refreshed 2 times.

It should be noted that the mixed refreshings of the first-color picture, the second-color picture, and the third-color picture may make the final display picture of the display panel richer, which is beneficial for improving the display effect of the display panel.

It should be further noted that the refreshing quantities and the refreshing time points of the first-color picture, the second-color picture, and the third-color picture may not be limited in one embodiment.

Optionally, the first color is green, the second color is red, and the third color is blue; or the first color is green, the second color is blue, and the third color is red.

It should be noted that red, green and blue are three primary colors of light. Different intensities of red, green and blue may be mixed to obtain various colors of light. Therefore, by setting the first color to green and setting the second color and the third color to be one and the other of red and blue, the display panel may be able to display a variety of colors and enrich the display color of the display panel.

On the other hand, the human eye's sensitivity to green is significantly higher than the sensitivity of red and blue, and the refreshing of the green picture has a greater impact on the generation of the picture flickering. By setting the first color to be green and the green picture refreshing timing to be evenly distributed in one frame, it may effectively improve the flickering phenomenon recognized by human eyes.

Optionally, for the second-color picture, the time interval between every two adjacent refreshings is T3, where T3=T2/E; and for the third-color picture, the time interval between every two adjacent refreshings is T4, where T4=T2/F.

Figure 9:
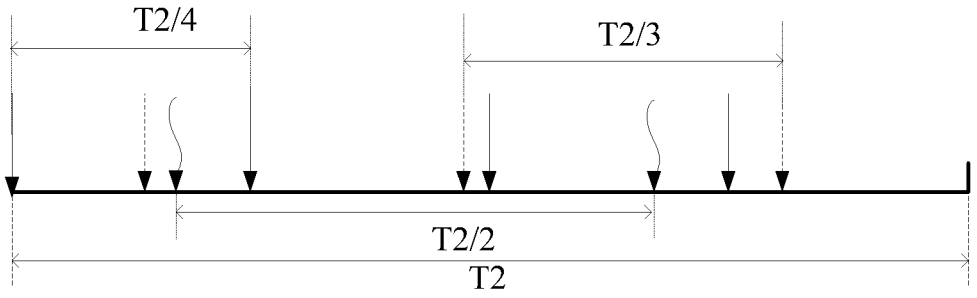
FIG. 9 illustrates another schematic of the distribution of picture refreshing time points in one frame according to various embodiments of the present disclosure.

Exemplarily, FIG. 9 illustrates another schematic of the distribution of picture refreshing time points in one frame according to various embodiments of the present disclosure. In FIG. 9, the one-way arrow is used to illustrate the picture refreshing time point. For example, a straight one-way arrow is used to illustrate the refreshing time point of the first-color picture, a dotted one-way arrow is used to illustrate the refreshing time point of the second-color picture, and a curved one-way arrow is used to illustrate the refreshing time point of the third second-color picture. As shown in FIG. 9, in one frame with the continuing duration of T2, the first-color picture may be refreshed 4 times, and for the first-color picture, the time interval between every two adjacent refreshings may be T2/4; the second-color picture may be refreshed 3 times, and for the second-color picture, the time interval between every two adjacent refreshings may be T2/3; the third-color picture may be refreshed 2 times, and for the third-color picture, the time interval between every two adjacent refreshings may be T2/2.

It should be noted that the refreshing timing of the second color picture and the third color picture are evenly distributed within one frame by using the above-mentioned setting manner, which may reduce the picture retention duration after refreshing the first-color picture and the third-color picture and further improve the flickering phenomenon of the display panel.

Figure 10:
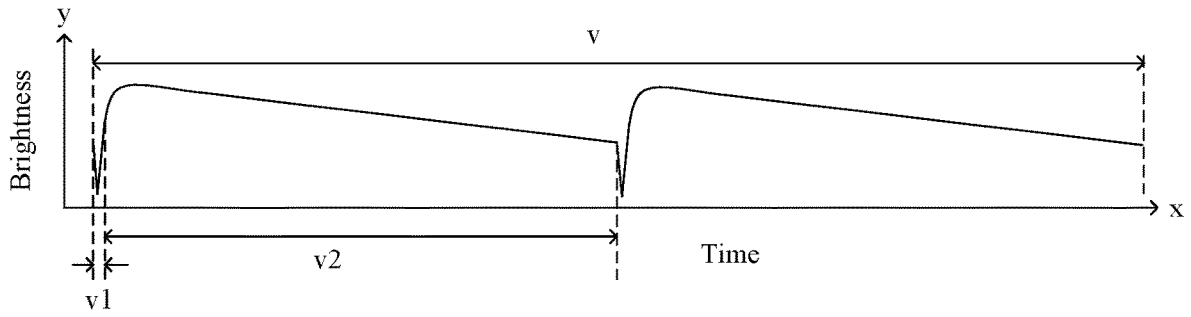
FIG. 10 illustrates a schematic of a change curve of display panel brightness with time in one frame according to various embodiments of the present disclosure.

On the basis of the above-mentioned embodiments, N=E=F=2 may be set. Exemplarily, FIG. 10 illustrates a schematic of a change curve of display panel brightness with time in one frame according to various embodiments of the present disclosure. As shown in FIG. 10, one frame v may include two picture refreshing stages v1 and two brightness retention stages v2, where the first-color picture, the second-color picture, and the third-color picture may be refreshed one time at each picture refreshing stage v1. For the first-color picture, the time interval between two refreshings is T2/2; for the second-color picture, the time interval between two refreshings is T2/2; and for the third-color picture, the time interval between two refreshings is T2/2.

Optionally, N is an even number, E=N/2, and F=N/2. The drive method of the display panel may include refreshing each of the second-color picture and the third-color picture one time while refreshing the first-color picture at the (2h−1)-th time, where 1≤h≤N/2.

Figure 11:
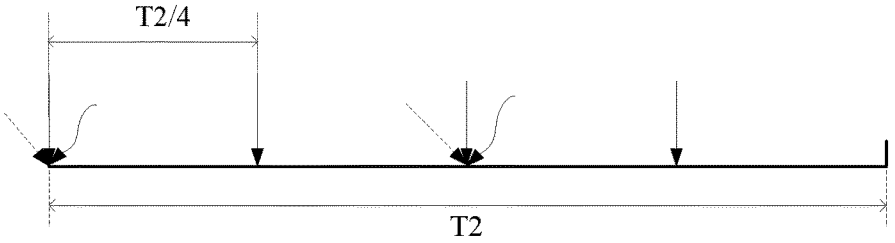
FIG. 11 illustrates another schematic of the distribution of picture refreshing time points in one frame according to various embodiments of the present disclosure.

Exemplarily, FIG. 11 illustrates another schematic of the distribution of picture refreshing time points in one frame according to various embodiments of the present disclosure. In FIG. 11, the one-way arrow is used to illustrate the picture refreshing time point. For example, a straight one-way arrow is used to illustrate the refreshing time point of the first-color picture, a dotted one-way arrow is used to illustrate the refreshing time point of the second-color picture, and a curved one-way arrow is used to illustrate the refreshing time point of the third second-color picture. As shown in FIG. 11, in one frame with the continuing duration of T2, the first-color picture may be refreshed 4 times, the second-color picture may be refreshed 2 times, and the third-color picture may be refreshed 2 times. For the first-color picture, the time interval between every two adjacent refreshings is T2/4; while the first-color picture is refreshed for the first time and the third time, each of the second-color picture and the third-color picture may be refreshed one time. That is, the time point of refreshing the first-color picture for the first time, the time point of refreshing the second-color picture for the first time, and the time point of refreshing the third-color picture for the first time may coincide with each other; and the time point of refreshing the first-color picture for the third time, the time point of refreshing the second-color picture for the second time, and the time point of refreshing the third-color picture for the second time may coincide with each other. It should be noted that the overlapping one-way arrows in FIG. 11 may indicate that the refreshing processes of the refreshed pictures represented by the one-way arrows are located in a same refreshing process between two brightness retention stages. For example, the one-way arrow representing the first-color picture may coincide with the one-way arrow representing the second-color picture. If the refreshing process of the first-color picture and the refreshing process of the second-color picture are independent of each other, the refreshing process of the first-color picture and the refreshing process of the second-color picture may be performed in a same refreshing process simultaneously, or the refreshing process of the first-color picture and the refreshing process of the second-color picture may be performed sequentially. If the refreshing process of the first-color picture and the refreshing process of the second-color picture are correlated with each other, the refreshing process of the first-color picture and the refreshing process of the second-color picture may be in a same scanning process.

It should be noted that only one refresh starting point is needed to refresh all of the first-color picture, the second-color picture, and the third-color picture in a certain refreshing process, such that the picture refreshing operations of all colors may be performed continuously or in combination. Therefore, it may be necessary to only set the refreshing time point of the first-color picture and may not be necessary to set the refreshing time points of the second-color picture and the third-color picture, which may be beneficial for reducing the difficulty of the time sequence design.

It should be further noted that the refreshing times of the second-color picture and the third-color pictures in one frame are half of the refreshing time of the first-color picture, such that the refreshing frequency of the first-color picture is higher than the refreshing frequency of each of the second-color picture and the third-color picture. When human eyes are more sensitive to the first color, it is difficult for the human eyes to recognize obvious picture flickering phenomenon when the first-color picture is refreshed with high refreshing frequency. Human eyes have a relatively low sensitivity to the second and third colors, such that the brightness changes of the second-color picture and the third-color picture may not be easily recognized by human eyes, and the low power consumption may be achieved by reducing the refreshing frequency of the second-color picture and the third-color picture.

In other implementation manners of one embodiment, each of the second-color picture and the third-color picture may be refreshed one time while refreshing the first-color picture at the 2h-th time, which may have a same beneficial effect as refreshing each of the second-color picture and the third-color picture one time while refreshing the first-color picture at the (2h−1)-th time.

Optionally, N is an even number, and N=2E=2F. The first-color picture may include the first first-color picture and the second first-color picture; the second-color picture may include a first second-color picture and a second second-color picture; and the third-color picture may include a first third-color picture and a second third-color picture. The display panel may include the plurality of first-color sub-pixels arranged in n rows, the plurality of second-color sub-pixels arranged in n rows, and the plurality of third-color sub-pixels arranged in n rows. Along a direction perpendicular to the row direction, the second-color sub-pixels, the first-color sub-pixels, and the third-color sub-pixels may be sequentially and periodically arranged. The first-color sub-pixels in the (2r−1)-th row may display the first first-color picture, the first-color sub-pixels in the 2r-th row may display the second first-color picture, the second-color sub-pixels in the (2r−1)-th row may display the first second-color picture, the second-color sub-pixels in the 2r-th row may display the second second-color picture, the third-color sub-pixels in the (2r−1)-th row may display the first third-color picture, and the third-color sub-pixels in the 2r-th row may display the second third-color picture, where 1≤r≤n/2, r and n are both positive integers, and n is an even number.

Figure 12:
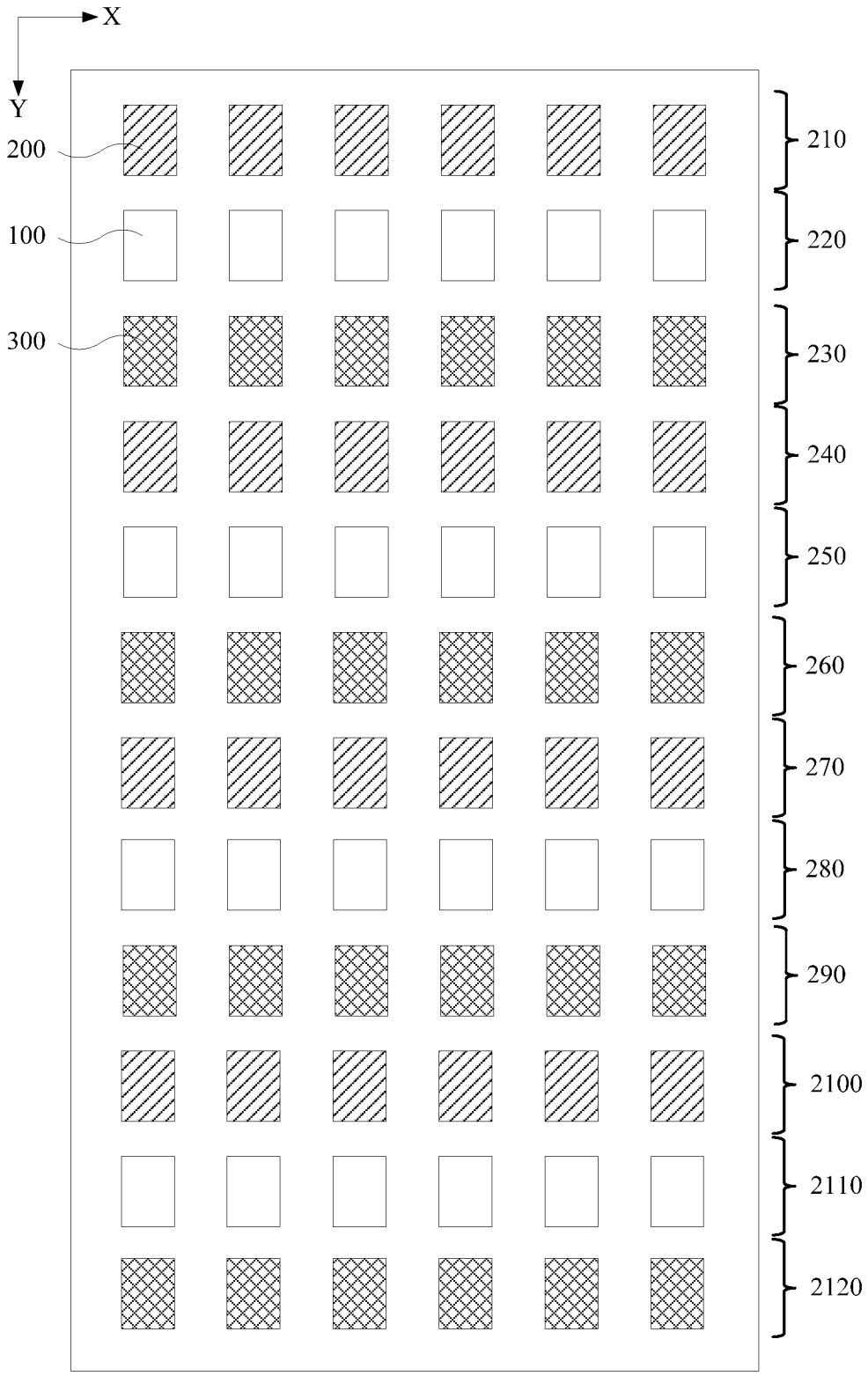
FIG. 12 illustrates a structural schematic of another display panel according to various embodiments of the present disclosure.

Exemplarily, FIG. 12 illustrates a structural schematic of another display panel according to various embodiments of the present disclosure. As shown in FIG. 12, the display panel includes the plurality of first-color sub-pixels 100 arranged in 4 rows, the plurality of second-color sub-pixels 200 arranged in 4 rows, and the plurality of third-color sub-pixels 300 arranged in 4 rows. Along the direction Y perpendicular to the row direction X, the second-color sub-pixels 200, the first-color sub-pixels 100, and the third-color sub-pixels 300 may be sequentially and periodically arranged, that is, the display panel may include 12 rows of sub-pixels. Sub-pixels 210 in the first row, sub-pixels 240 in the fourth row, sub-pixels 270 in the seventh row, and sub-pixels 2100 in the tenth row may include the second-color sub-pixels 200; sub-pixels 220 in the second row, sub-pixels 250 in the fifth row, sub-pixels 280 in the eighth row, and sub-pixels 2110 in the eleventh row may include the first-color sub-pixels 100; and sub-pixels 230 in the third row, sub-pixels 260 in the sixth row, sub-pixels 290 in the ninth row, and sub-pixels 2120 in the twelfth row may include the third-color sub-pixels 300. The sub-pixels 210 in the first row and the sub-pixels 270 in the seventh row (the second-color sub-pixels in odd rows) may display the first second-color picture; the sub-pixels 240 in the fourth row and the sub-pixels 2100 in the tenth row (the second-color sub-pixels in even rows) may display the second second-color picture; the sub-pixels 220 in the second row and the sub-pixels 280 in the eighth row (the first-color sub-pixels in odd rows) may display the first first-color picture; the sub-pixels 250 in the fifth row and the sub-pixels 2110 in the eleventh row (the first-color sub-pixels in even rows) may display the second first-color picture; the sub-pixels 230 in the third row and the sub-pixels 290 in the ninth row (the third-color sub-pixels in odd rows) may display the first third-color picture; and the sub-pixels 260 in the sixth row and the sub-pixels 2120 in the twelfth row (the third-color sub-pixels in even rows) may display the second third-color picture.

The corresponding drive method may include alternately performing the first group of refreshing operations and the second group of refreshing operations in one frame till the first group of refreshing operations and the second group of refreshing operations are both performed N/2 times. The first group of refreshing operations may include refreshing the first second-color picture, the first first-color picture, the first third-color picture, and the second first-color picture. The second group of refreshing operations may include refreshing the second second-color picture, the first first-color picture, the second third-color picture, and the second first-color picture.

It should be noted that, in any group of refreshing operations, half of the second-color sub-pixels, half of the third-color sub-pixels, and all of the first-color sub-pixels in the display panel may be scanned; and in a next group of refreshing operations, the other half of the second-color sub-pixels, the other half of the third-color sub-pixels, and all of the first-color sub-pixels in the display panel may be scanned. On the one hand, the refreshing frequency of the first-color picture may be relatively high, and the refreshing timing may be evenly distributed, which effectively improves the picture flickering phenomenon of the display panel. On the other hand, by setting the refreshing frequency of the second-color picture and the third-color picture to be relatively small, the power consumption of the display panel may be reduced. Furthermore, in two adjacent refreshing operations, all of the first-color sub-pixels, the second-color sub-pixels, and the third-color sub-pixels may be scanned, which avoids over-scanning of a portion of the sub-pixels in monochrome sub-pixels and further avoids the life span reduction of the display panel.

The refreshing order of the plurality of pictures in the first group of refreshing operations and the scanning manners of the sub-pixels may not be limited according to various embodiments of the present disclosure, and designers may make corresponding adjustments according to actual needs.

Figure 13:
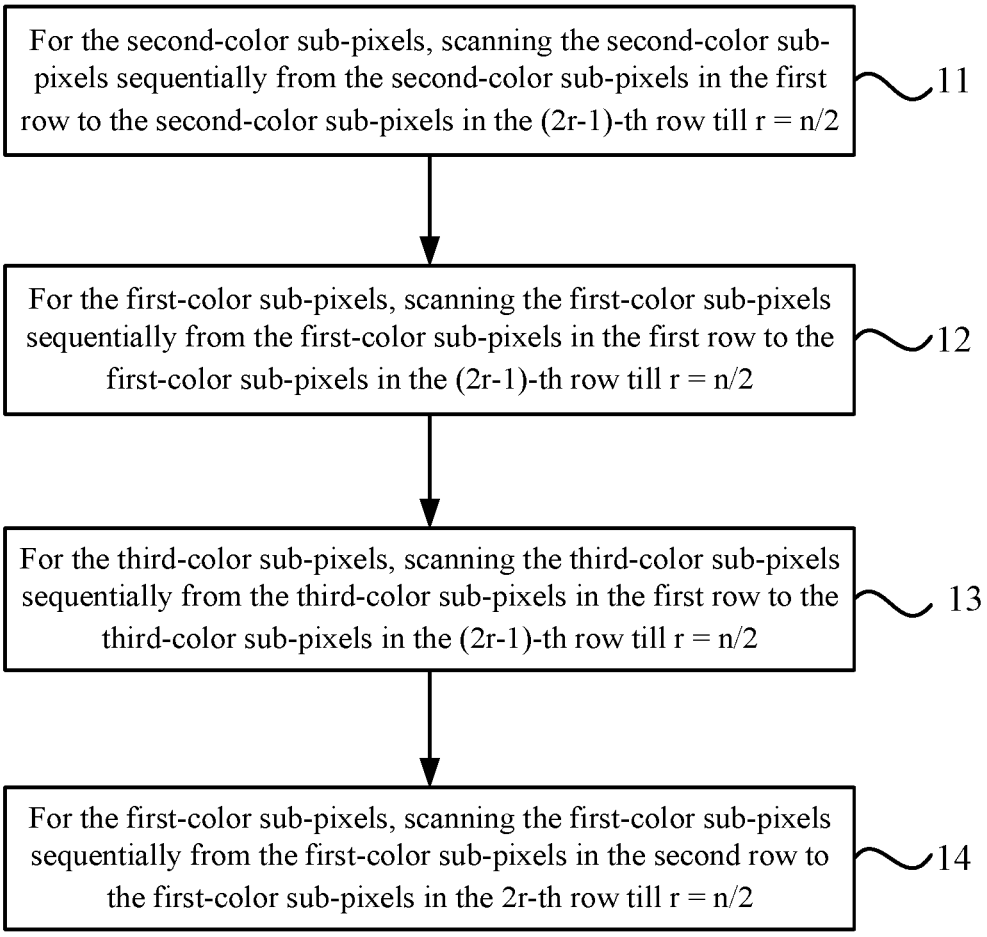
FIG. 13 illustrates a flow chart of a first group of refreshing operations according to various embodiments of the present disclosure.

Optionally, FIG. 13 illustrates a flow chart of the first group of refreshing operations according to various embodiments of the present disclosure. As shown in FIG. 13, the first group of refreshing operations may include the following steps.

At step 11, for the second-color sub-pixels, the second-color sub-pixels may be scanned sequentially from the second-color sub-pixels in the first row to the second-color sub-pixels in the (2r−1)-th row till r=n/2.

At step 12, for the first-color sub-pixels, the first-color sub-pixels may be scanned sequentially from the first-color sub-pixels in the first row to the first-color sub-pixels in the (2r−1)-th row till r=n/2.

At step 13, for the third-color sub-pixels, the third-color sub-pixels may be scanned sequentially from the third-color sub-pixels in the first row to the third-color sub-pixels in the (2r−1)-th row till r=n/2.

At step 14, for the first-color sub-pixels, the first-color sub-pixels may be scanned sequentially from the first-color sub-pixels in the second row to the first-color sub-pixels in the 2r-th row till r=n/2.

Figure 14:
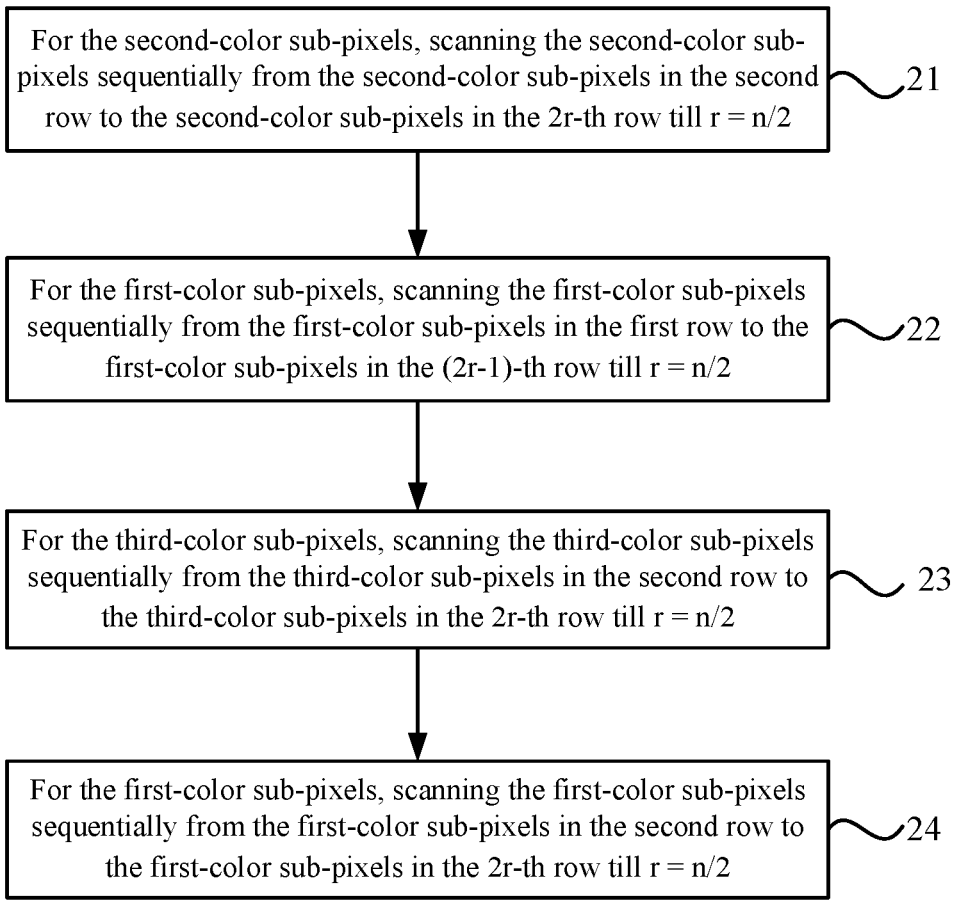
FIG. 14 illustrates a flow chart of a second group of refreshing operations according to various embodiments of the present disclosure.

Correspondingly, FIG. 14 illustrates a flow chart of the second group of refreshing operations according to various embodiments of the present disclosure. As shown in FIG. 14, the second group of refreshing operations may include the following steps.

At step 21, for the second-color sub-pixels, the second-color sub-pixels may be scanned sequentially from the second-color sub-pixels in the second row to the second-color sub-pixels in the 2r-th row till r=n/2.

At step 22, for the first-color sub-pixels, the first-color sub-pixels may be scanned sequentially from the first-color sub-pixels in the first row to the first-color sub-pixels in the (2r−1)-th row till r=n/2.

At step 23, for the third-color sub-pixels, the third-color sub-pixels may be scanned sequentially from the third-color sub-pixels in the second row to the third-color sub-pixels in the 2r-th row till r=n/2.

At step 24, for the first-color sub-pixels, the first-color sub-pixels may be scanned sequentially from the first-color sub-pixels in the second row to the first-color sub-pixels in the 2r-th row till r=n/2.

Figure 15:
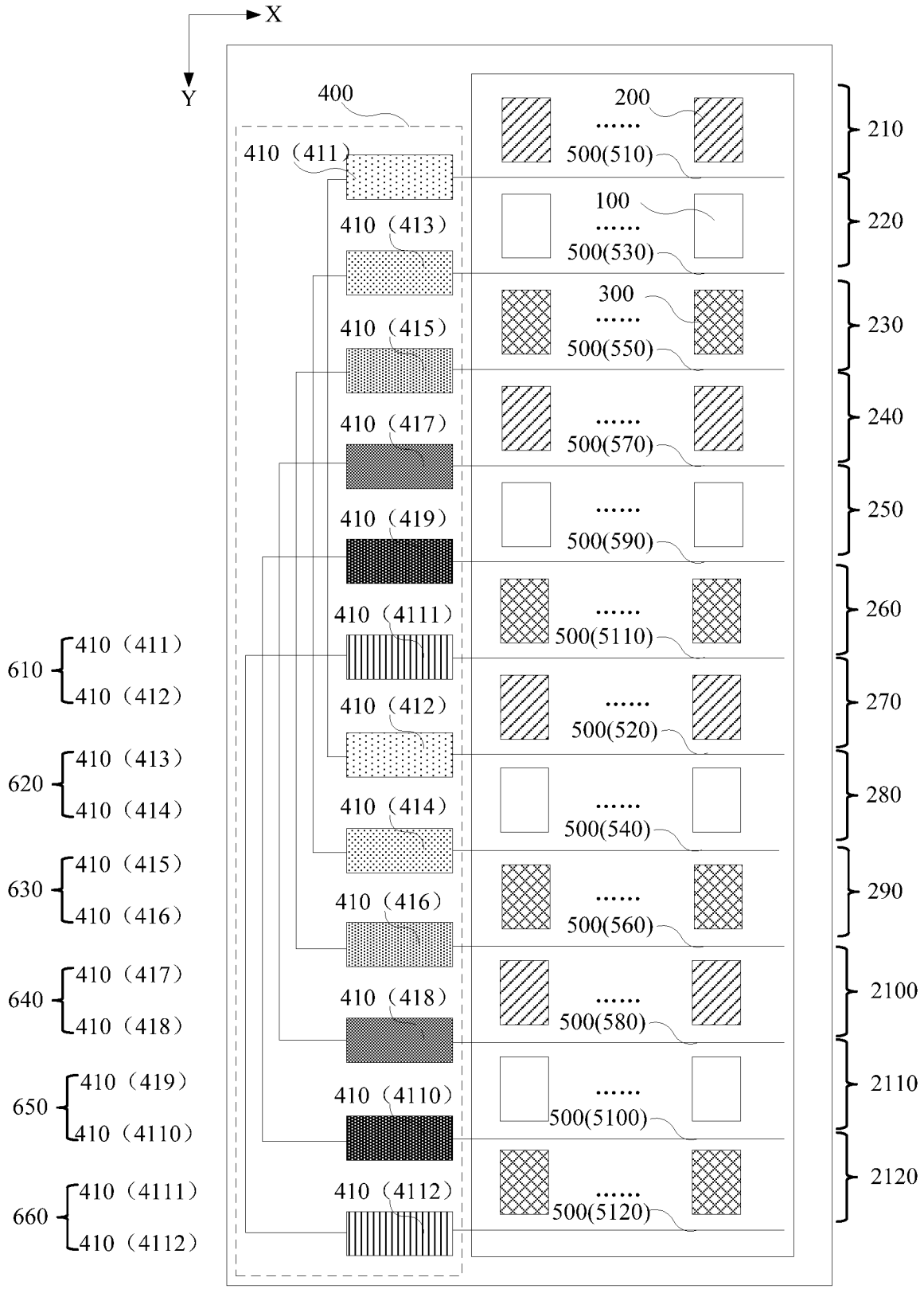
FIG. 15 illustrates a structural schematic of another display panel according to various embodiments of the present disclosure.

Examples are used to describe above-mentioned embodiments hereinafter. For example, FIG. 15 illustrates a structural schematic of another display panel according to various embodiments of the present disclosure. FIG. 15 only illustrates two sub-pixels at the beginning and end of each row of sub-pixels, respectively. As shown in FIG. 15, based on the display panel shown in FIG. 12, the display panel may further include a gate driving circuit 400 and a plurality of scan lines 500. The gate driving circuit 400 may include a plurality of shift registers 410. The shift registers 410 and the scan lines 500 may be connected in a one-to-one correspondence, and each scan line 500 may be connected to a row of sub-pixels. The plurality of shift registers 410 may include 6 shift register groups; two shift registers 410 in each shift register group may be cascaded; and the sub-pixels correspondingly connected to each shift register group may be configured to display one picture. For example, the sub-pixels 210 in the first row and the sub-pixels 270 in the seventh row (the second-color sub-pixels in odd rows) may display the first second-color picture. A first shift register group 610 may include a first shift register 411 and a second shift register 412. The first shift register 411 may be connected to a first scan line 510, and the second shift register 412 may be connected to a second scan line 520. The first scan line 510 may be connected to the sub-pixels 210 in the first row, and the second scan line 520 may be connected to the sub-pixels 270 in the seventh row.

In the first group of refreshing operations, the first shift register group 610 may be driven to sequentially transmit scan signals to the first scan line 510 and the second scan line 520, thereby scanning the sub-pixels 210 in the first row and the sub-pixels 270 in the seventh row; the second shift register group 620 may be driven to sequentially transmit scan signals to the third scan line 530 and the fourth scan line 540, thereby scanning the sub-pixels 220 in the second row and the sub-pixels 280 in the eighth row; the third shift register group 630 may be driven to sequentially transmit scan signals to the fifth scan line 550 and the sixth scan line 560, thereby scanning the sub-pixels 230 in the third row and the sub-pixels 290 in the ninth row; and the fifth shift register group 650 may be driven to sequentially transmit scan signals to the ninth scan line 590 and the tenth scan line 5100, thereby scanning the sub-pixels 250 in the fifth row and the sub-pixels 2110 in the eleventh row.

In the second group of refreshing operations, the fourth shift register group 640 may be driven to sequentially transmit scan signals to the seventh scan line 570 and the eighth scan line 580, thereby scanning the sub-pixels 240 in the fourth row and the sub-pixels 2110 in the tenth row; the second shift register group 620 may be driven to sequentially transmit scan signals to the third scan line 530 and the fourth scan line 540, thereby scanning the sub-pixels 220 in the second row and the sub-pixels 280 in the eighth row; the sixth shift register group 660 may be driven to sequentially transmit scan signals to the eleventh scan line 5110 and the twelfth scan line 5120, thereby scanning the sub-pixels 260 in the sixth row and the sub-pixels 2120 in the twelfth row; and the fifth shift register group 650 may be driven to sequentially transmit scan signals to the ninth scan line 590 and the tenth scan line 5100, thereby scanning the sub-pixels 250 in the fifth row and the sub-pixels 2110 in the eleventh row.

Figure 16:
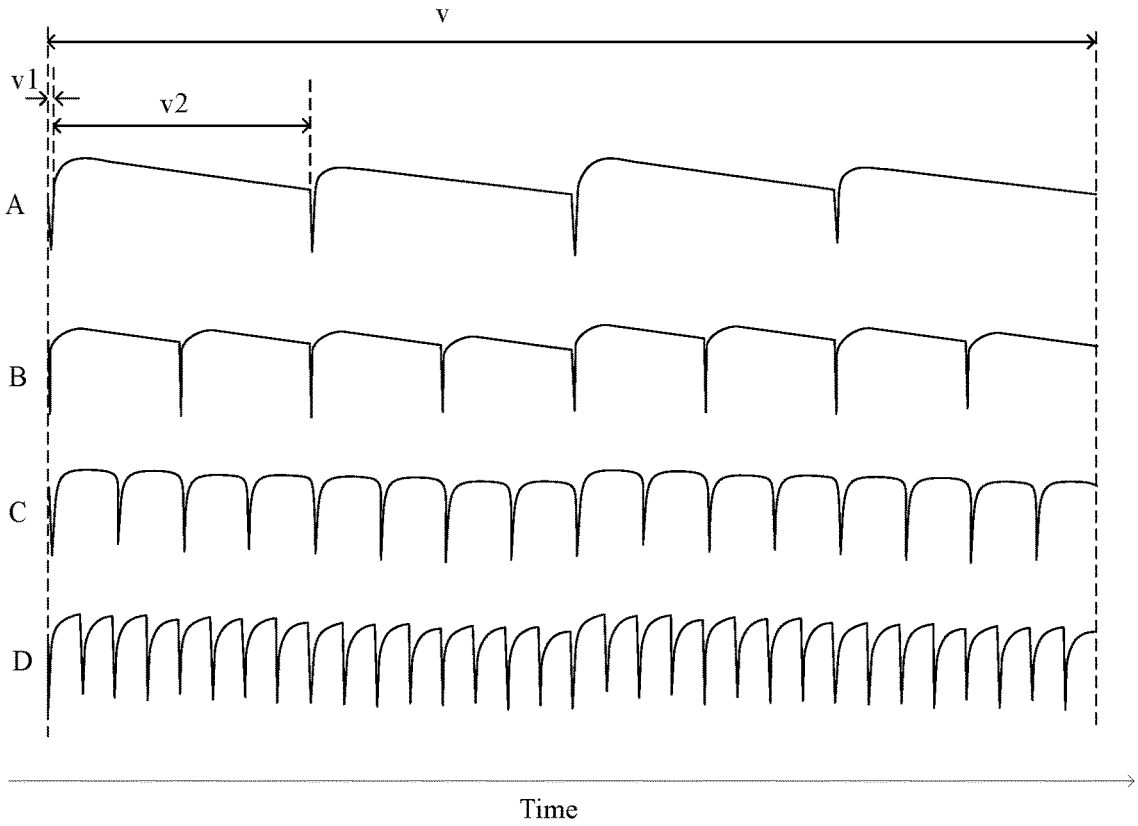
FIG. 16 illustrates another schematic of a change curve of display panel brightness with time in one frame according to various embodiments of the present disclosure.

On the basis of the above-mentioned embodiments, optionally, FIG. 16 illustrates a schematic of another change curve of display panel brightness with time in one frame according to various embodiments of the present disclosure. For example, in FIG. 16, a curve A is a change curve corresponding to alternately performing the first group of refreshing operations and the second group of refreshing operations 1 time, a curve B is a change curve corresponding to alternately performing the first group of refreshing operations and the second group of refreshing operations 2 times, a curve C is a change curve corresponding to alternately performing the first group of refreshing operations and the second group of refreshing operations 4 times, and a curve D is a change curve corresponding to alternately performing the first group of refreshing operations and the second group of refreshing operations 8 times. It should be noted that the ordinates of the curve A, the curve B, the curve C, and the curve D are integrated brightness, such that the brightness correlational relationship in the four curves may be more intuitively. As shown in FIG. 16, one frame v may include a plurality of picture refreshing stages and a plurality of brightness retention stages for any curve (FIG. 16 only illustrates one picture refreshing stage v1 and one brightness retention stage v2 in the curve A). At the (4i+1)-th picture refreshing stage, the first second-color picture, the first first-color picture, and the first third-color picture may be refreshed. At the (4i+2)-th picture refreshing stage, the second first-color picture may be refreshed. At the (4i+3)-th picture refreshing stage, the second second-color picture, the first first-color picture, and the second third-color picture may be refreshed. At the (4i+4)-th picture refreshing stage, the second first-color picture may be refreshed, where $0 \le i \le (N-4)/4$, and i is an integer.

As shown in FIG. 16, as the quantity of picture refreshings increase, the brightness reduction amount of the display panel in each brightness retention stage may be reduced, and the human eyes may be more difficult to perceive the brightness change, which effectively improves the picture flickering phenomenon of the display panel.

Figure 17:
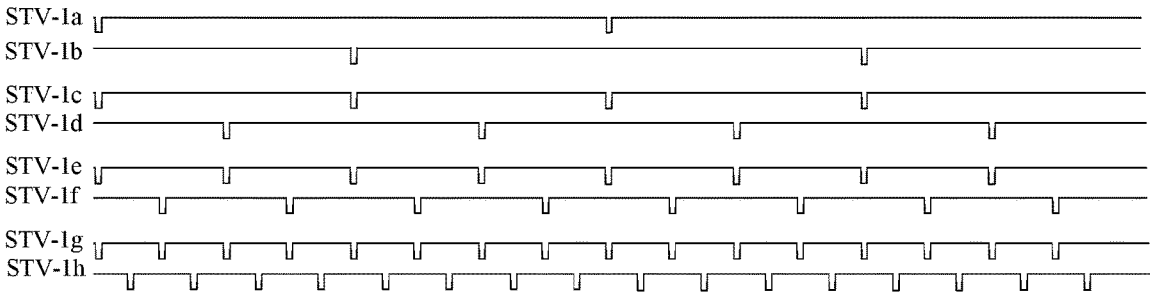
FIG. 17 illustrates a time sequence diagram of STV signals in one frame according to various embodiments of the present disclosure.

Exemplarily, the refreshing time interval of two adjacent pictures of a same color may be determined by the input time of STV signals in FIG. 16. For example, FIG. 17 illustrates a time sequence diagram of the STV signals in one frame according to various embodiments of the present disclosure. As shown in FIG. 17, the waveforms STV-1*a* and STV-1*b* are the time sequence diagrams of the STV signals respectively corresponding to the first first-color picture and the second first-color picture in the curve A of FIG. 16; the waveforms STV-1*c* and STV-1*d* are the time sequence diagrams of the reset signals respectively corresponding to the first first-color picture and the second first-color picture in the curve B of FIG. 16; the waveforms STV-1*e* and STV-1*f* are the time sequence diagrams of the reset signals respectively corresponding to the first first-color picture and the second first-color picture in the curve C of FIG. 16; and the waveforms STV-1*g* and STV-1*h* are the time sequence diagrams of the reset signals respectively corresponding to the first first-color picture and the second first-color picture in the curve D of FIG. 16. As shown in FIG. 17, the reset signals of the plurality of first-color pictures are evenly distributed in one frame in each picture refreshing manner corresponding to FIG. 16.

Figure 18:
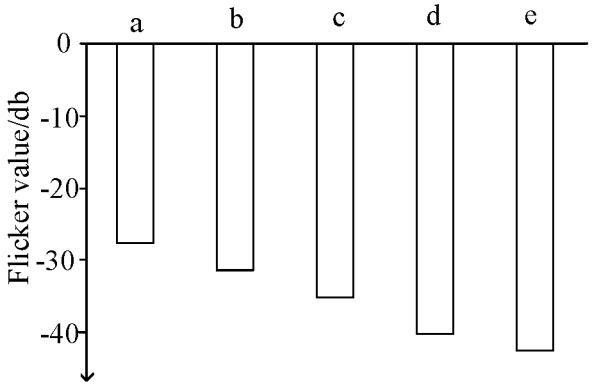
FIG. 18 illustrates a histogram of picture flicker values under different picture refreshing manners according to various embodiments of the present disclosure.

FIG. 18 illustrates a histogram of picture flicker values under different picture refreshing manners according to various embodiments of the present disclosure. For example, FIG. 18 may be obtained by a white picture test. A column a may be measured in the following picture refreshing manner in the existing technology: refreshing pictures of different colors 1 time in one frame. A column b may be measured in the picture refreshing manner corresponding to the curve A in FIG. 18. A column c may be measured in the picture refreshing manner corresponding to the curve B in FIG. 18. A column d may be measured in the picture refreshing manner corresponding to the curve C in FIG. 18. A column e may be measured in the picture refreshing manner corresponding to the curve D in FIG. 18. As shown in FIG. 18, as the refreshing quantity of the first color-picture in one frame increases, the flicker value of the display panel may become smaller, thereby improving the flickering phenomenon of the display panel.

Optionally, another implementation manner may also be included in one embodiment. For example, the first group of refreshing operations may include sequentially and periodically scanning the second-color sub-pixels in the (2r−1)-th row, the first-color sub-pixels in the (2r−1)-th row, the third-color sub-pixels in the (2r−1)-th row, and the first-color sub-pixels in the 2r-th row till r=n/2.

Correspondingly, the second group of refreshing operations may include sequentially and periodically scanning the second-color sub-pixels in the 2r-th row, the first-color sub-pixels in the (2r−1)-th row, the third-color sub-pixels in the 2r-th row, and the first-color sub-pixels in the 2r-th row till r=n/2.

Figure 19:
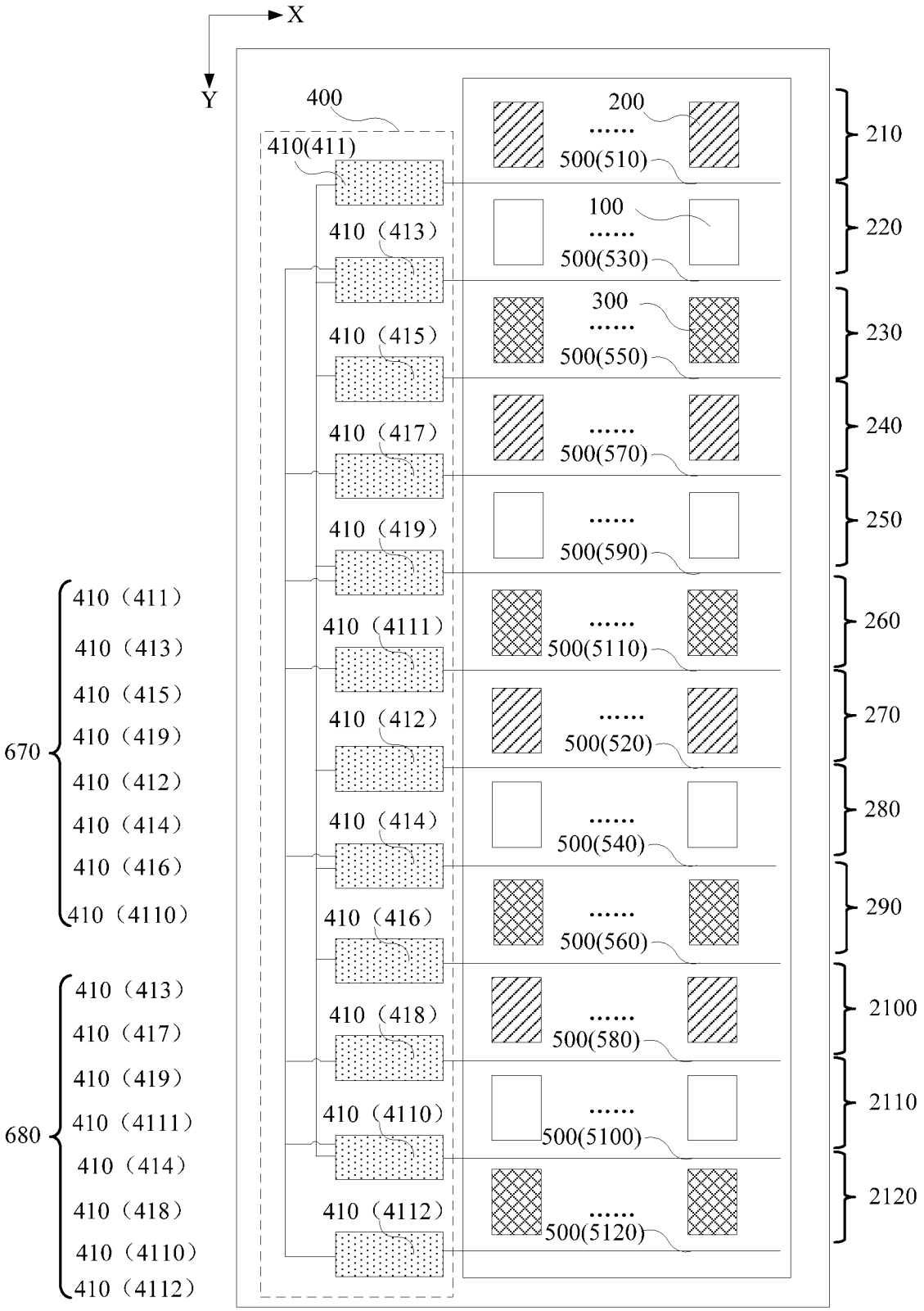
FIG. 19 illustrates a structural schematic of another display panel according to various embodiments of the present disclosure.

Similarly, examples are used to describe above-mentioned implementation manners hereinafter. For example, FIG. 19 illustrates a structural schematic of another display panel according to various embodiments of the present disclosure. As shown in FIG. 19, based on the display panel shown in FIG. 12, the display panel may further include the gate driving circuit 400 and the plurality of scan lines 500. The gate driving circuit 400 may include the plurality of shift registers 410. The shift registers 410 and the scan lines 500 may be connected in a one-to-one correspondence, and each scan line 500 may be connected to a row of sub-pixels. The plurality of shift registers 410 may include 2 shift register groups; the shift registers 410 in each shift register group may be cascaded; and the sub-pixels correspondingly connected to each shift register group may be configured to display four pictures in one group of refreshing operations. For example, the first group of refreshing operations may include refreshing the first second-color picture, the first first-color picture, the first third-color picture, and the second first-color picture. The shift registers 410, which are connected to the sub-pixels 210 in the first row, the sub-pixels 220 in the second row, the sub-pixels 230 in the third row, the sub-pixels 250 in the fifth row, the sub-pixels 270 in the seventh row, the sub-pixels 280 in the eighth row, the sub-pixels 290 in the ninth row, and the sub-pixels 2110 in the eleventh row for displaying the above-mentioned four pictures, may belong to a seventh shift register group 670. The second group of refreshing operations may include refreshing the second second-color picture, the first first-color picture, the second third-color picture, and the second first-color picture. The shift registers 410, which are connected to the sub-pixels 240 in the fourth row, the sub-pixels 220 in the second row, the sub-pixels 250 in the fifth row, the sub-pixels 260 in the sixth row, the sub-pixels 280 in the eighth row, the sub-pixels 2100 in the tenth row, the sub-pixels 2110 in the ninth row, and the sub-pixels 2120 in the twelfth row for displaying the above-mentioned four pictures, may belong to a eighth shift register group 680.

In the first group of refreshing operations, the seventh shift register group 670 may be driven to sequentially transmit scan signals to the first scan line 510, the third scan line 530, the fifth scan line 550, the ninth scan line 590, the second scan line 520, the fourth scan line 540, the sixth scan line 560, and the tenth scan line 5100, thereby scanning the sub-pixels 210 in the first row, the sub-pixels 220 in the second row, the sub-pixels 230 in the third row, the sub-pixels 250 in the fifth row, the sub-pixels 270 in the seventh row, the sub-pixels 280 in the eighth row, the sub-pixels 290 in the ninth row, and the sub-pixels 2110 in the eleventh row.

In the second group of refreshing operations, the eighth shift register group 680 may be driven to sequentially transmit scan signals to the seventh scan line 570, the third scan line 530, the eleventh scan line 5110, the ninth scan line 590, the eighth scan line 580, the fourth scan line 540, the twelfth scan line 5120, the tenth scan line 5100, thereby scanning the sub-pixels 240 in the fourth row, the sub-pixels 220 in the second row, the sub-pixels 260 in the sixth row, the sub-pixels 250 in the fifth row, the sub-pixels 2100 in the tenth row, the sub-pixels 280 in the eighth row, the sub-pixels 2120 in the twelfth row, and the sub-pixels 2110 in the eleventh row.

It should be noted that the first group of refreshing operations and the second group of refreshing operations are exemplarily described with two scanning methods with convenient time sequence designs and regular scanning processes. It should be understood that, in other embodiments of the present disclosure, the scanning manners of the sub-pixels in the first group of refreshing operations and the second group of refreshing operations may be other scenarios, and all manners that may implement the first group of refreshing operations and the second group of refreshing operations are within the protection scope of the present disclosure.

Figure 20:
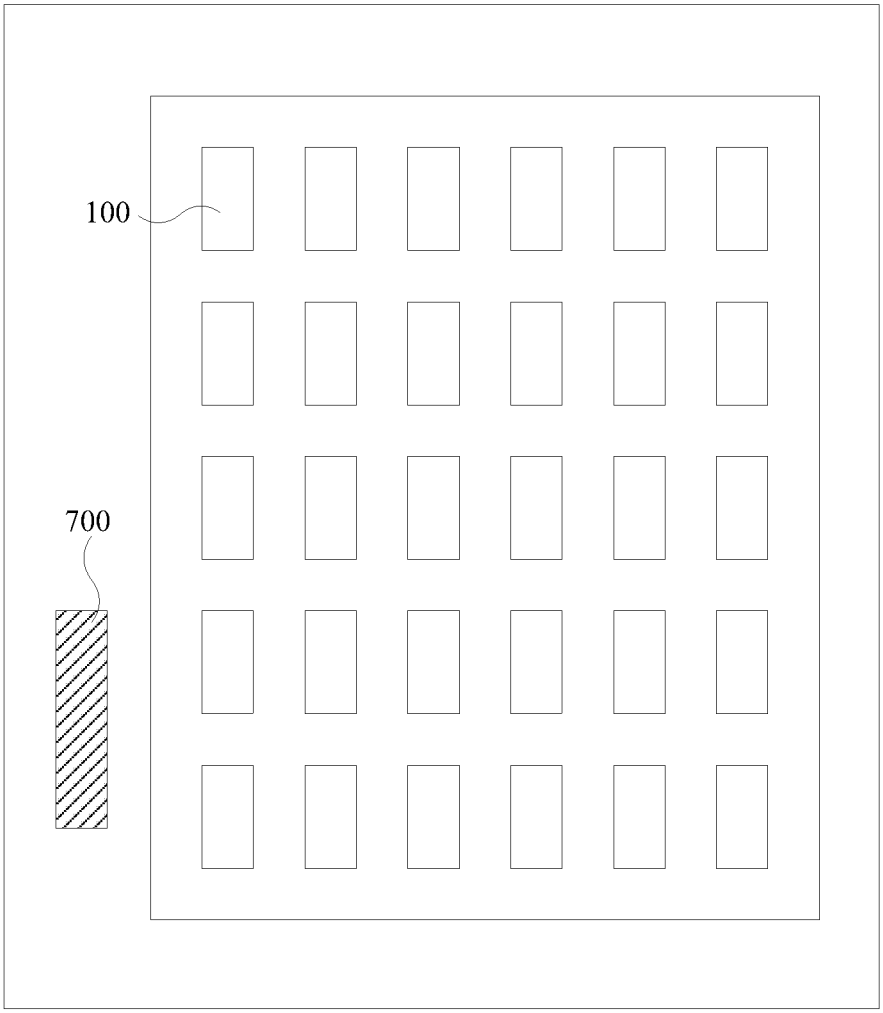
FIG. 20 illustrates a structural schematic of another display panel according to various embodiments of the present disclosure.

FIG. 20 illustrates a structural schematic of another display panel according to various embodiments of the present disclosure. As shown in FIG. 20, the display panel may include a picture refreshing module 700 and a plurality of first-color sub-pixels 100. The picture refreshing module 700 may be configured to refresh the first-color picture N time in one frame. For the first-color picture, the time interval between two adjacent refreshings is T1, where T1=T2/N, T2 is the duration of one frame, N>1, and N is a positive integer. At least a portion of the first-color sub-pixels 100 may be configured to display the first-color picture.

The picture refreshing module in the display panel provided by the embodiments of the present disclosure may be configured to refresh the first-color picture N time in one frame. For the first-color picture, the time interval between two adjacent refreshings is T1, where T1=T2/N, T2 is the duration of one frame, N>1, and N is a positive integer. In such way, the first-color picture may be refreshed multiple times in one frame, and the refreshing timing of the first-color picture may be evenly distributed, which may reduce the picture retention duration after the first-color picture is refreshed. Furthermore, before human eyes are not able to recognize the brightness reduction of a previous first-color picture, a next first-color picture is refreshed, thereby effectively improving the picture flickering phenomenon of the display panel.

Figure 21:
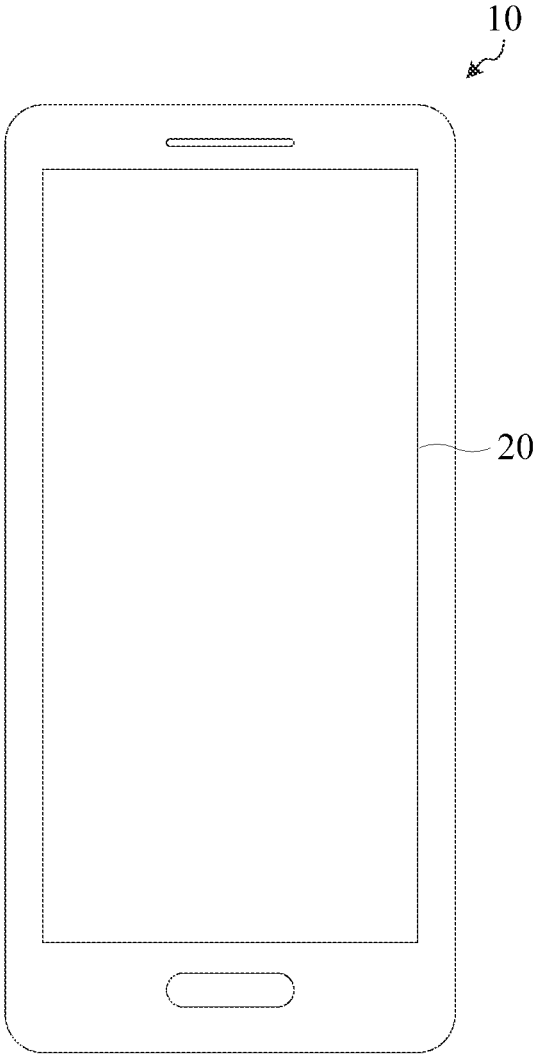
FIG. 21 illustrates a structural schematic of a display device according to various embodiments of the present disclosure.

FIG. 21 illustrates a structural schematic of a display device according to various embodiments of the present disclosure. As shown in FIG. 21, a display device 10 may include a display panel 20 provided by any one of the embodiments of the present disclosure. Since the display device 10 provided in one embodiment includes the display panel 20 provided by any one of the embodiments of the present disclosure, the display device 10 may have the same or corresponding beneficial effect as the display panel 20 included in the display device 10, which may not be described in detail herein.

Furthermore, the display device 10 may further include a control circuit. The control circuit may be configured to provide the display panel 20 with electrical signals required for normal operation and may perform data storage and output based on a unit of picture frame, where the picture frame may include all pictures in one frame.

It should be noted that, when displaying in the display panel 20, one frame of data may correspond to a complete display picture, that is, one frame of data is a whole. In order to maintain the continuity of one frame of data, the data storage and output may be performed based on the unit of picture frame.

From the above-mentioned embodiments, it can be seen that the display panel and its drive method, and the display device provided by the present disclosure may achieve at least the following beneficial effects.

In the technical solution provided by the embodiments of the present disclosure, the first-color picture may be refreshed N time in one frame. For the first-color picture, the time interval between two adjacent refreshings is T1, where T1=T2/N, T2 is the duration of one frame, N>1, and N is a positive integer. In such way, the first-color picture may be refreshed multiple times in the one frame, and the multiple refreshing processes of the first-color picture may be evenly distributed, which may reduce each picture retention duration after the first-color picture is refreshed. Furthermore, before the human eyes are not able to recognize the brightness decrease of a previous first-color picture, a next first-color picture is refreshed, thereby effectively improving the picture flickering phenomenon of the display panel.

The above may merely be the preferred embodiments of the present disclosure and applied technical principles. Those skilled in the art should understand that the present disclosure may not be limited to the embodiments described herein, and various obvious changes, readjustments, mutual combinations and substitutions may be made by those skilled in the art without departing from the protection scope of the present disclosure. Therefore, although the present disclosure has been described in detail through the above-mentioned embodiments, the present disclosure may not be limited to the above-mentioned embodiments and may also include other more equivalent embodiments without departing from the concept of the present disclosure. The scope of the present disclosure may be determined by the scope of the appended claims.

What is claimed is:

1. A method for driving a display panel, comprising:

refreshing a first-color picture N times in one frame, wherein:

a time interval between every two adjacent refreshings of the N times of the refreshings is T1 for the first-color picture, T1=T2/N, T2 is a duration of the one frame, N >1, and N is a positive integer;

the display panel includes a plurality of first-color sub-pixels arranged in n rows, and the plurality of first-color sub-pixels is configured to display the first-color picture; and refreshing the first-color picture N times includes:

at step 1, sequentially scanning the plurality of first-color sub-pixels from a first row to an i-th row till i=n, wherein 1≤i≤n, and i is a positive integer; and at step 2, repeating step 1 for N−1 times.

2. The method according to claim 1, wherein:

the time interval T1 between every two adjacent refreshings includes:

in two adjacent refreshings of the first-color picture, a time interval between scans of a first first-color sub-pixel is T1.

3. The method according to claim 1, further including:

performing a first refreshing of the first-color picture at a starting point of a frame scan in the one frame.

4. The method according to claim 1, wherein:

the first-color picture includes pictures from a first first-color picture to an M-th first-color picture;

first-color sub-pixels in an (M*j+k)-th row displays a k-th first-color picture, wherein 1<M≤N, 1≤k≤M, 0≤j≤n/M−1, and M, k, and j are all integers; and refreshing the first-color picture N times includes:

sequentially performing a first refreshing operation to an M-th refreshing operation, wherein an k-th refreshing operation includes sequentially scanning first-color sub-pixels from a k-th row to the (M*j+k)-th row till j=[n/M−1].

5. The method according to claim 4, wherein:

N is an integer multiple of M, and refreshing the first-color picture N times includes sequentially repeating operations from the first refreshing operation to the M-th refreshing operation c times, wherein c=N/M.

6. The method according to claim 1, further including:

in the one frame, refreshing a second-color picture E times and refreshing a third-color picture F times, wherein 1≤E≤N, 1≤F≤N, and E and F are both positive integers.

7. The method according to claim 6, wherein:

the first color is green, the second color is red, and the third color is blue; or the first color is green, the second color is blue, and the third color is red.

8. The method according to claim 6, wherein:

for the second-color picture, a time interval between every two adjacent refreshings is T3, wherein T3=T2/E; and for the third-color picture, a time interval between every two adjacent refreshings is T4, wherein T4=T2/F.

9. The method according to claim 6, wherein:

N is an even number, E=N/2, and F=N/2; and the drive method includes:

in the one frame, refreshing each of the second-color picture and the third-color picture respectively for one time, while refreshing the first-color picture at a (2h−1)-th time, wherein 1≤h≤N/2.

10. The method according to claim 6, wherein:

N is an even number, and N=2E=2F;

the first-color picture includes a first first-color picture and a second first-color picture; the second-color picture includes a first second-color picture and a second second-color picture; and the third-color picture includes a first third-color picture and a second third-color picture;

the display panel further includes a plurality of second-color sub-pixels arranged in n rows, and a plurality of third-color sub-pixels arranged in n rows;

along a direction perpendicular to a row direction, the plurality of second-color sub-pixels, the plurality of first-color sub-pixels, and the plurality of third-color sub-pixels are sequentially and periodically arranged;

first-color sub-pixels in a (2r−1)-th row display the first first-color picture, first-color sub-pixels in a 2r-th row display the second first-color picture, second-color sub-pixels in the (2r−1)-th row display the first second-color picture, second-color sub-pixels in the 2r-th row display the second second-color picture, third-color sub-pixels in the (2r−1)-th row display the first third-color picture, third-color sub-pixels in the 2r-th row display the second third-color picture, wherein 1≤r≤n/2, r and n are both positive integers, and n is an even number; and the drive method includes:

in one frame, alternately performing a first group of refreshing operations and a second group of refreshing operations till the first group of refreshing operations and the second group of refreshing operations are both performed for N/2 times, wherein:

the first group of refreshing operations include refreshing the first second-color picture, the first first-color picture, the first third-color picture, and the second first-color picture; and the second group of refreshing operations include refreshing the second second-color picture, the first first-color picture, the second third-color picture, and the second first-color picture.

11. The method according to claim 10, wherein:

the first group of refreshing operations includes:

for the second-color sub-pixels, scanning the second-color sub-pixels sequentially from the second-color sub-pixels in a first row to the second-color sub-pixels in the (2r−1)-th row till r=n/2;

for the first-color sub-pixels, scanning the first-color sub-pixels sequentially from the first-color sub-pixels in the first row to the first-color sub-pixels in the (2r−1)-th row till r=n/2;

for the third-color sub-pixels, scanning the third-color sub-pixels sequentially from the third-color sub-pixels in the first row to the third-color sub-pixels in the (2r−1)-th row till r=n/2; and for the first-color sub-pixels, scanning the first-color sub-pixels sequentially from the first-color sub-pixels in a second row to the first-color sub-pixels in the 2r-th row till r=n/2; and the second group of refreshing operations includes:

for the second-color sub-pixels, scanning the second-color sub-pixels sequentially from the second-color sub-pixels in the second row to the second-color sub-pixels in the 2r-th row till r=n/2;

for the first-color sub-pixels, scanning the first-color sub-pixels sequentially from the first-color sub-pixels in the first row to the first-color sub-pixels in the (2r−1)-th row till r=n/2;

for the third-color sub-pixels, scanning the third-color sub-pixels sequentially from the third-color sub-pixels in the second row to the third-color sub-pixels in the 2r-th row till r=n/2; and for the first-color sub-pixels, scanning the first-color sub-pixels sequentially from the first-color sub-pixels in the second row to the first-color sub-pixels in the 2r-th row till r=n/2.

12. The method according to claim 10, wherein:

the first group of refreshing operations includes:

sequentially and periodically scanning the second-color sub-pixels in the (2r−1)-th row, the first-color sub-pixels in the (2r−1)-th row, the third-color sub-pixels in the (2r−1)-th row, and the first-color sub-pixels in the 2r-th row till r=n/2; and the second group of refreshing operations includes:

sequentially and periodically scanning the second-color sub-pixels in the 2r-th row, the first-color sub-pixels in the (2r−1)-th row, the third-color sub-pixels in the 2r-th row, and the first-color sub-pixels in the 2r-th row till r=n/2.

13. A display panel, comprising:

a plurality of first-color sub-pixels, wherein:

a first-color picture is configured to be refreshed N times in one frame, wherein a time interval between every two adjacent refreshings of the N times of the refreshings is T1 for the first-color picture, T1=T2/N, T2 is a duration of the one frame, N >1, and N is a positive integer;

the display panel includes a plurality of first-color sub-pixels arranged in n rows, and the plurality of first-color sub-pixels is configured to display the first-color picture; and refreshing the first-color picture N times includes:

at step 1, sequentially scanning the plurality of first-color sub-pixels from a first row to an i-th row till i=n, wherein 1≤i≤n, and i is a positive integer; and at step 2, repeating step 1 for N−1 times.

14. The display panel according to claim 13, wherein:

the time interval T1 between every two adjacent refreshings includes:

in two adjacent refreshings of the first-color picture, a time interval between scans of a first first-color sub-pixel is T1.

15. The display panel according to claim 13, further including:

performing a first refreshing of the first-color picture at a starting point of a frame scan in the one frame.

16. A display device, comprising:

a display panel, comprising:

a plurality of first-color sub-pixels, wherein:

a first-color picture is configured to be refreshed N times in one frame, wherein a time interval between every two adjacent refreshings of the N times of the refreshings is T1 for the first-color picture, T1=T2/N, T2 is a duration of the one frame, N >1, and N is a positive integer;

the display panel includes a plurality of first-color sub-pixels arranged in n rows, and the plurality of first-color sub-pixels is configured to display the first-color picture; and refreshing the first-color picture N times includes:

at step 1, sequentially scanning the plurality of first-color sub-pixels from a first row to an i-th row till i=n, wherein 1≤i≤n, and i is a positive integer; and at step 2, repeating step 1 for N−1 times.

17. The device according to claim 16, further including:

a control circuit, configured to provide the display panel with electrical signals required for normal operation, and perform data storage and output based on a unit of picture frame.

* * * * *